US008041292B2

(12) United States Patent
Milbar

(10) Patent No.: US 8,041,292 B2
(45) Date of Patent: Oct. 18, 2011

(54) NETWORK RADIO RECEIVER

(75) Inventor: Marek Milbar, Huntingdon Valley, PA (US)

(73) Assignee: iBiquity Digital Corporation, Columbia, MD (US)

( * ) Notice: Subject to any disclaimer, the term of this patent is extended or adjusted under 35 U.S.C. 154(b) by 1292 days.

(21) Appl. No.: 11/634,045

(22) Filed: Dec. 4, 2006

(65) Prior Publication Data

US 2008/0130686 A1 Jun. 5, 2008

(51) Int. Cl.
*H04H 1/00* (2006.01)

(52) U.S. Cl. ..... 455/3.01; 455/3.06; 455/414.4; 455/464; 370/486; 370/487; 370/414; 370/466

(58) Field of Classification Search ..... 455/3.01, 455/30.2, 3.03, 3.06, 414.1, 414.4, 41.1, 455/41.2, 41.3, 11.1, 552.1, 12.1; 726/21; 709/203, 231, 227, 201, 226; 370/486, 352, 370/338, 390, 414, 417, 466, 467; 725/61, 725/46, 86, 135, 142, 105; 707/104.1
See application file for complete search history.

(56) References Cited

U.S. PATENT DOCUMENTS

| | | | | |
|---|---|---|---|---|
| 6,459,427 | B1 | 10/2002 | Mao et al. | |
| 6,493,873 | B1 | 12/2002 | Williams | |
| 6,493,875 | B1 | 12/2002 | Eames et al. | |
| 6,732,183 | B1 | 5/2004 | Graham | |
| 6,757,913 | B2 | 6/2004 | Knox | |
| 6,810,233 | B2 | 10/2004 | Patsiokas | |
| 6,925,285 | B2 * | 8/2005 | Kim | 455/3.02 |
| 6,981,050 | B1 | 12/2005 | Tobias et al. | |
| 7,010,263 | B1 | 3/2006 | Patsiokas | |
| 7,099,951 | B2 * | 8/2006 | Laksono | 709/231 |
| 7,200,855 | B2 * | 4/2007 | Laksono | 725/82 |
| 7,301,900 | B1 * | 11/2007 | Laksono | 370/230 |
| 7,617,515 | B1 * | 11/2009 | Laksono | 725/93 |
| 2002/0106987 | A1 * | 8/2002 | Linden | 455/12.1 |
| 2002/0178277 | A1 * | 11/2002 | Laksono | 709/231 |
| 2003/0092376 | A1 * | 5/2003 | Syed | 455/3.06 |
| 2003/0135857 | A1 * | 7/2003 | Pendakur et al. | 725/61 |
| 2003/0156218 | A1 * | 8/2003 | Laksono | 348/388.1 |
| 2003/0208777 | A1 * | 11/2003 | Danker et al. | 725/135 |
| 2004/0064208 | A1 * | 4/2004 | Sinha et al. | 700/94 |
| 2004/0076188 | A1 * | 4/2004 | Milbar et al. | 370/514 |
| 2006/0019601 | A1 * | 1/2006 | Kroeger et al. | 455/3.06 |
| 2006/0080707 | A1 * | 4/2006 | Laksono | 725/38 |
| 2006/0109808 | A1 | 5/2006 | Ritter | |
| 2006/0123053 | A1 * | 6/2006 | Scannell, Jr. | 707/104.1 |
| 2006/0126716 | A1 | 6/2006 | Williams et al. | |
| 2006/0209941 | A1 | 9/2006 | Kroeger | |
| 2006/0270347 | A1 * | 11/2006 | Ibrahim et al. | 455/41.2 |

(Continued)

FOREIGN PATENT DOCUMENTS

| | | | |
|---|---|---|---|
| DE | 10339123 | A1 | 12/2004 |
| EP | 1657836 | A2 | 5/2006 |
| WO | WO2005062534 | A1 | 7/2005 |

*Primary Examiner* — Tan Trinh
(74) *Attorney, Agent, or Firm* — Robert P. Lenart, Esq.; Pietragallo Gordon Alfano Bosick & Raspanti, LLP

(57) ABSTRACT

An apparatus includes a network receiver for receiving an over-the-air in-band on-channel broadcast signal and extracting broadcast content from the broadcast signal, and an output for delivering the content by way of a first receiver output signal to a plurality of network player devices. A method performed by the apparatus is also included.

18 Claims, 13 Drawing Sheets

U.S. PATENT DOCUMENTS

2007/0061846 A1 3/2007 Gollwitzer
2007/0123244 A1* 5/2007 Paila ..... 455/419
2007/0268886 A1* 11/2007 Caspi et al. ..... 370/352
2009/0031419 A1* 1/2009 Laksono ..... 726/21

* cited by examiner

NETWORK RADIO RECEIVER

FIELD OF THE INVENTION

This invention relates to methods and apparatus for radio reception, and more particularly, to methods and apparatus for distributing in-band on-channel (IBOC) digital audio broadcasting (DAB) radio signals.

BACKGROUND OF THE INVENTION

IBOC DAB radio broadcasting technology delivers digital audio and data services to mobile, portable, and fixed receivers from terrestrial transmitters in the existing Medium Frequency (MF) and Very High Frequency (VHF) radio bands. IBOC DAB signals can be transmitted in a hybrid format including an analog modulated carrier in combination with a plurality of digitally modulated carriers or in an all-digital format wherein the analog modulated carrier is not used. Using the hybrid mode, broadcasters may continue to transmit analog AM and FM simultaneously with higher-quality and more robust digital signals, allowing themselves and their listeners to convert from analog to digital radio while maintaining their current frequency allocations.

One feature of digital transmission systems is the inherent ability to simultaneously transmit both digitized audio and data. Thus the technology also allows for wireless data services from AM and FM radio stations. The broadcast signals can include metadata, such as the artist, song title, or station call letters. Special messages about events, traffic, and weather can also be included. For example, traffic information, weather forecasts, news and sports scores, can all be scrolled across a radio receiver's display while the user listens to a radio station.

IBOC DAB technology can provide digital quality audio, superior to existing analog broadcasting formats. Because each IBOC DAB signal is transmitted within the spectral mask of an existing AM or FM channel allocation, it requires no new spectral allocations. IBOC DAB promotes economy of spectrum while enabling broadcasters to supply digital quality audio to the present base of listeners.

Multicasting, the ability to deliver several programs or data streams over one channel in the AM or FM spectrum, enables stations to broadcast multiple streams of data on separate supplemental or sub-channels of the main frequency. For example, multiple streams of data can include alternative music formats, local traffic, weather, news and sports. The supplemental channels can be accessed in the same manner as the traditional station frequency using tuning or seeking functions. For example, if the analog modulated signal is centered at 94.1 MHz, the same broadcast in IBOC DAB can include supplemental channels 94.1-1, 94.1-2, and 94.1-3. Highly specialized programming on supplemental channels can be delivered to tightly targeted audiences, creating more opportunities for advertisers to integrate their brand with program content.

The National Radio Systems Committee, a standard setting organization sponsored by the National Association of Broadcasters and the Consumer Electronics Association, adopted an IBOC standard, designated NRSC-5A, in September 2005. NRSC-5A, the disclosure of which is incorporated herein by reference, sets forth the requirements for broadcasting digital audio and ancillary data over AM and FM broadcast channels. The standard and its reference documents contain detailed explanations of the RF/transmission subsystem and the transport and service multiplex subsystem for the system. Copies of the standard can be obtained from the NRSC at http://www.nrscstandards.org/standards.asp. HD Radio™ technology, developed by iBiquity Digital Corporation, is an implementation of the NRSC-5A IBOC standard. Further information regarding HD Radio™ technology can be found at www.hdradio.com and www.ibiquity.com.

It would be desirable to provide methods and apparatus that can distribute program material and/or information received by an IBOC DAB receiver to a plurality of users having access to a local area network, such as a home or office network. It would further be desirable for a system employing such methods and apparatus to be highly flexible and configurable such that content can be distributed to users that have different devices for receiving the content, such as a computer, television or home theater, cell phone, personal music player, and other hand-held or portable devices. Moreover, different users of a received signal may be interested in different programs or data streams transmitted in a single IBOC DAB channel. It would therefore be desirable to provide methods and apparatus that can allow different users to access different programs and data services transmitted on a single channel.

SUMMARY OF THE INVENTION

In a first aspect, the invention provides an apparatus including a network receiver for receiving an over-the-air in-band on-channel broadcast signal and extracting broadcast content from the broadcast signal, and an output for delivering the content by way of a first receiver output signal to one or more network player devices.

The network receiver can include a network receiver interface for formatting the first receiver output signal according to a network access protocol. The network receiver can also include a front end for converting the broadcast signal to a baseband signal, and a processor for processing the baseband signal according to a protocol stack to produce an intermediate signal, wherein the network receiver interface processes the intermediate signal to produce the output signal. The intermediate signal can be encrypted.

The apparatus can further include a network player including a network player interface for receiving the receiver output signal, and a processor for processing the receiver output signal according to a network access protocol to recover the content. The network player can exchange command and status information with the network receiver. A user interface having controls for activating functions of the network receiver can also be included.

A network router for receiving the receiver output signal and distributing the content to one or more network players can also be included. Additional network receivers can be used to receive additional over-the-air in-band on-channel broadcast signals, extract broadcast content from the additional broadcast signals, and deliver the additional content by way of a second receiver output signal to one or more network player devices.

In another aspect, the invention provides a method including: receiving an over-the-air in-band on-channel broadcast signal and extracting broadcast content from the broadcast signal, and delivering the content by way of a first receiver output signal to one or more network player devices.

The method can further include: converting the broadcast signal to a baseband signal, processing the baseband signal according to a protocol stack to produce an intermediate signal, and processing the intermediate signal to produce the output signal. The intermediate signal can be encrypted. The content can include multiple programs and/or data received in a single broadcast channel.

In another aspect, the invention provides a network player comprising an interface for receiving a signal derived from an in-band on-channel broadcast, the signal including a plurality of protocol data units, and a processor for processing the protocol data units according to a logical protocol stack to recover content. The interface can exchange command and status information with a network receiver. A user interface having controls for activating functions of a network receiver can also be included. The network player can further include a storage device for storing the protocol data units.

DETAILED DESCRIPTION OF THE INVENTION

Figure 1:
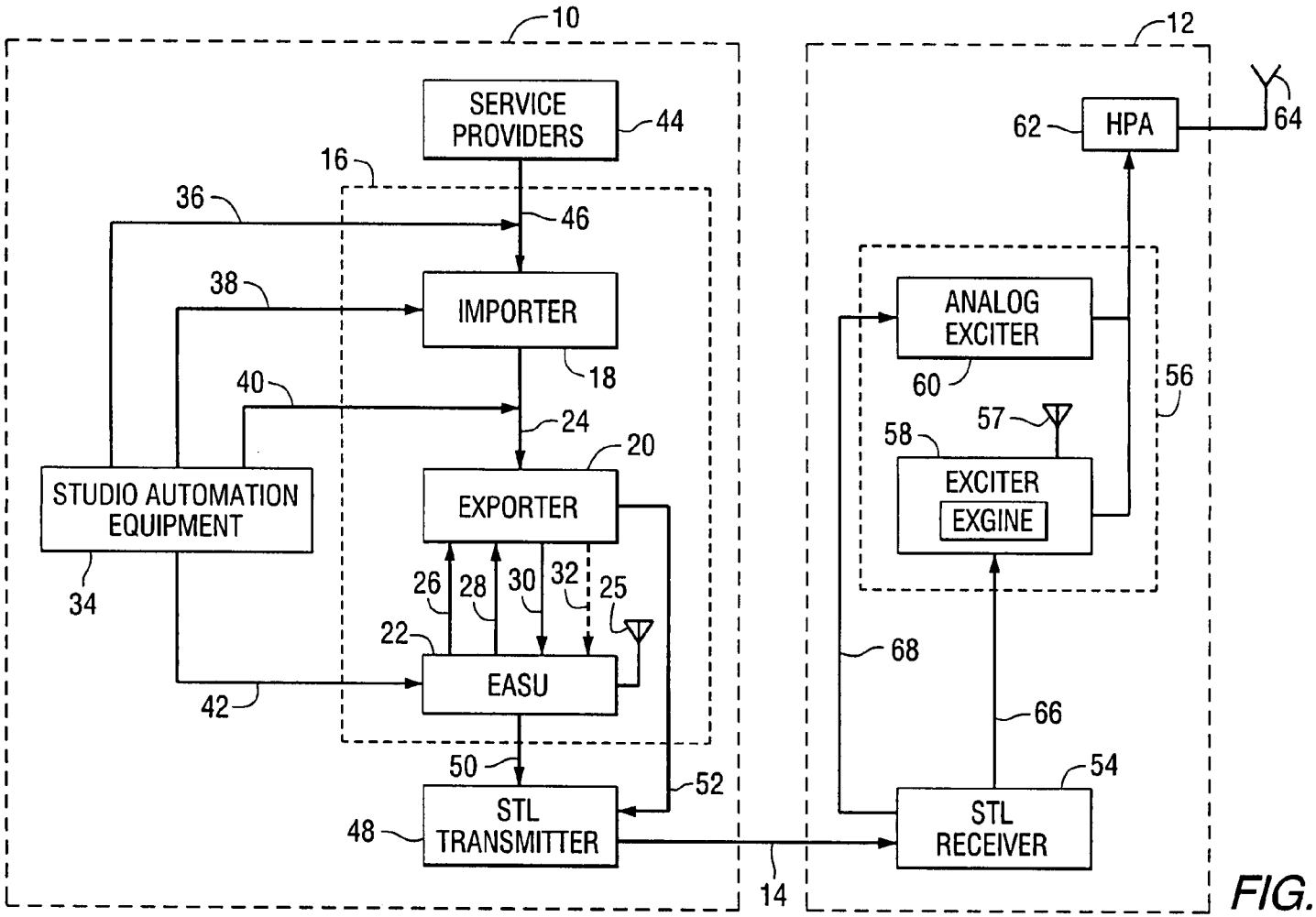
FIG. 1 is a block diagram of a transmitter for use in an in-band on-channel digital audio broadcasting system.

Referring to the drawings, FIG. 1 is a functional block diagram of the relevant components of a studio site 10, an FM transmitter site 12, and studio-to-transmitter link (STL) 14 that can be used to broadcast an FM IBOC DAB signal. The studio site includes, among other things, studio automation equipment 34, an Ensemble Operations Center (EOC) 16 that includes an importer 18, an exporter 20 and an exciter auxiliary service unit (EASU) 22, and a studio transmitter link (STL) transmitter 48. The transmitter site includes an STL receiver 54, a digital exciter 56 that includes an exciter engine (exgine) subsystem 58, and an analog exciter 60. While in FIG. 1 the exporter is resident at a radio station's studio site and the exciter is located at the transmission site, these elements may be co-located at the transmission site.

At the studio site, the studio automation equipment supplies main program service (MPS) audio 42 to the EASU, MPS data 40 to the exporter, supplemental program service (SPS) audio 38 to the importer, and SPS data 36 to the importer. MPS audio serves as the main audio programming source. In hybrid modes, it preserves the existing analog radio programming formats in both the analog and digital transmissions. MPS data, also known as program service data (PSD), includes information such as music title, artist, album name, etc. Supplemental program service can include supplementary audio content as well as program associated data.

The importer contains hardware and software for supplying advanced application services (AAS). A "service" is content that is delivered to users via an IBOC DAB broadcast, and AAS can include any type of data that is not classified as MPS or SPS. Examples of AAS data include real-time traffic and weather information, navigation map updates or other images, electronic program guides, multicast programming, multimedia programming, other audio services, and other content. The content for AAS can be supplied by service providers 44, which provide service data 46 to the importer via an application program interface (API). The service providers may be a broadcaster located at the studio site or externally sourced, and the importer can establish session connections between multiple service providers. The importer encodes and multiplexes service data 46, SPS audio 38, and SPS data 36 to produce exporter link data 24, which is output to the exporter via a data link.

The exporter 20 contains the hardware and software necessary to supply the main program service and station information service (SIS) for broadcasting. SIS provides station information, such as call sign, absolute time, position correlated to GPS, etc. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC DAB broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment, rate converts it to the proper system clock, and outputs two copies of the signal, one digital (26) and one analog (28). The EASU includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bidirectional. The STL link may be a digital microwave or Ethernet link, for example, and may use the standard User Datagram Protocol or the standard TCP/IP.

The transmitter site includes an STL receiver 54, an exciter 56 and an analog exciter 60. The STL receiver 54 receives exciter link data, including audio and data signals as well as command and control messages, over the STL link 14. The exciter link data is passed to the exciter 56, which produces the IBOC DAB waveform. The exciter includes a host processor, digital up-converter, RF up-converter, and exgine subsystem 58. The exgine accepts exciter link data and modulates the digital portion of the IBOC DAB waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 includes a GPS unit and antenna 57. An alternative method for synchronizing the exporter and exciter clocks can be found in U.S. patent application Ser. No. 11/081,267 (Publication No. 2006/0209941 A1), the disclosure of which is hereby incorporated by reference. The RF up-converter of the exciter up-converts the analog signal to the proper in-band channel frequency. The up-converted signal is then passed to the high power amplifier 62 and antenna 64 for broadcast. In an AM transmission system, the exgine subsystem coherently adds the backup analog MPS audio to the digital waveform in the hybrid mode; thus, the AM transmission system does not include the analog exciter 60. In addition, the exciter 56 produces phase and magnitude information and the analog signal is output directly to the high power amplifier.

IBOC DAB signals can be transmitted in both AM and FM radio bands, using a variety of waveforms. The waveforms include an FM hybrid IBOC DAB waveform, an FM all-digital IBOC DAB waveform, an AM hybrid IBOC DAB waveform, and an AM all-digital IBOC DAB waveform.

Figure 2:
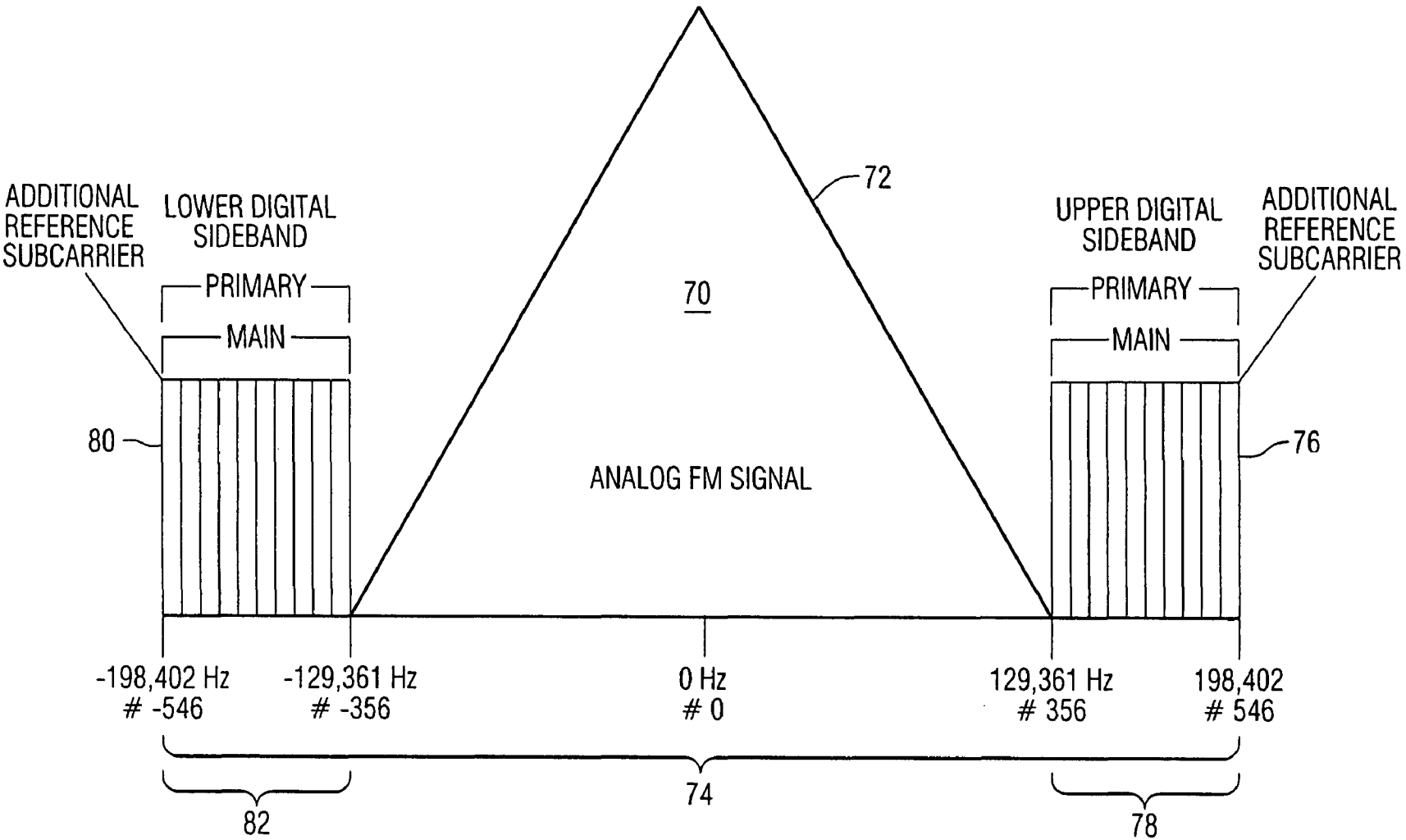
FIG. 2 is a schematic representation of a hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 OFDM subcarriers containing 18 data subcarriers and one reference subcarrier.

The hybrid waveform includes an analog FM-modulated signal, plus digitally modulated primary main subcarriers. The subcarriers are located at evenly spaced frequency locations. The subcarrier locations are numbered from −546 to +546. In the waveform of FIG. 2, the subcarriers are at locations +356 to +546 and −356 to −546. Each primary main sideband is comprised of ten frequency partitions. Subcarriers 546 and −546, also included in the primary main sidebands, are additional reference subcarriers. The amplitude of each subcarrier can be scaled by an amplitude scale factor.

Figure 3:
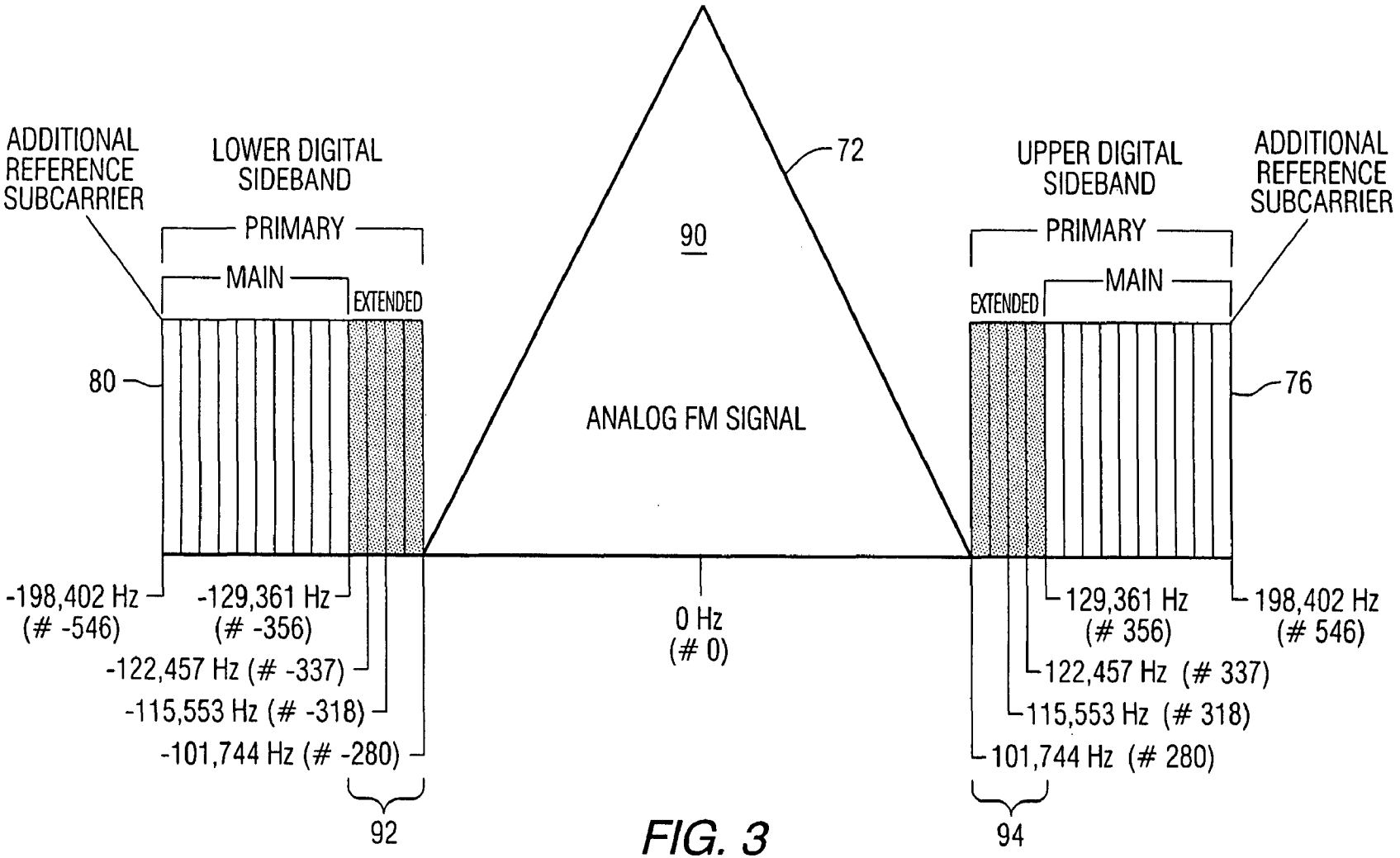
FIG. 3 is a schematic representation of an extended hybrid FM IBOC waveform.

FIG. 3 is a schematic representation of an extended hybrid FM IBOC waveform 90. The extended hybrid waveform is created by adding primary extended sidebands 92, 94 to the primary main sidebands present in the hybrid waveform. Depending on the service mode, one, two, or four frequency partitions can be added to the inner edge of each primary main sideband. The extended hybrid waveform includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337 through −355 (one frequency partition), −318 through −355 (two frequency partitions), or −280 through −355 (four frequency partitions). The amplitude of each subcarrier can be scaled by an amplitude scale factor.

Figure 4:
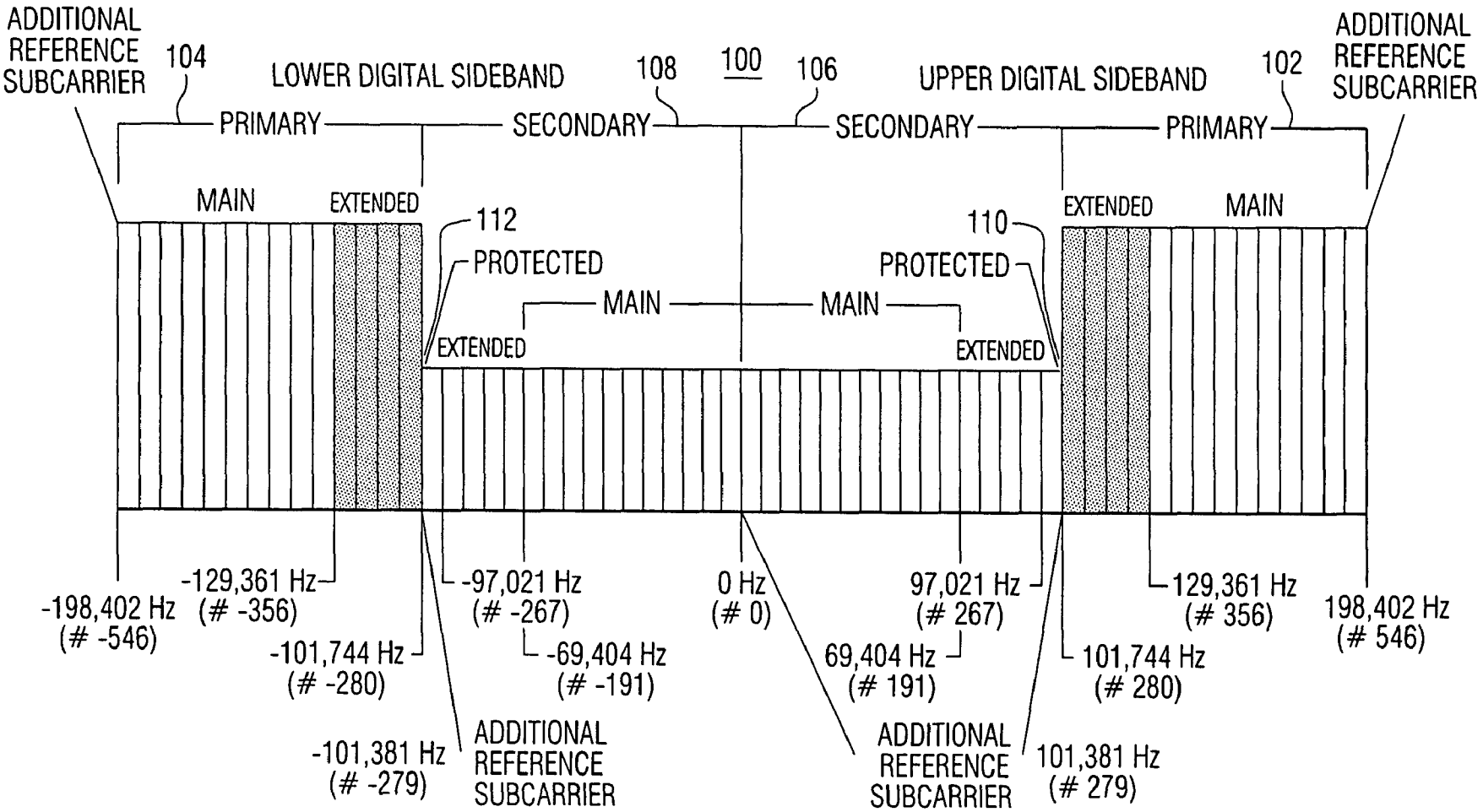
FIG. 4 is a schematic representation of an all-digital FM IBOC waveform.

FIG. 4 is a schematic representation of an all-digital FM IBOC waveform 100. The all-digital waveform is constructed by disabling the analog signal, fully expanding the bandwidth of the primary digital sidebands 102, 104, and adding lower-power secondary sidebands 106, 108 in the spectrum vacated by the analog signal. The all-digital waveform in the illustrated embodiment includes digitally modulated subcarriers at subcarrier locations −546 to +546, without an analog FM signal.

In addition to the ten main frequency partitions, all four extended frequency partitions are present in each primary sideband of the all-digital waveform. Each secondary sideband also has ten secondary main (SM) and four secondary extended (SX) frequency partitions. Unlike the primary sidebands, however, the secondary main frequency partitions are mapped nearer to the channel center with the extended frequency partitions farther from the center.

Each secondary sideband also supports a small secondary protected (SP) region 110, 112 including 12 OFDM subcarriers and reference subcarriers 279 and −279. The sidebands are referred to as "protected" because they are located in the area of spectrum least likely to be affected by analog or digital interference. An additional reference subcarrier is placed at the center of the channel (0). Frequency partition ordering of the SP region does not apply since the SP region does not contain frequency partitions.

Each secondary main sideband spans subcarriers 1 through 190 or −1 through −190. The upper secondary extended sideband includes subcarriers 191 through 266, and the upper secondary protected sideband includes subcarriers 267 through 278, plus additional reference subcarrier 279. The lower secondary extended sideband includes subcarriers −191 through −266, and the lower secondary protected sideband includes subcarriers −267 through −278, plus additional reference subcarrier −279. The total frequency span of the entire all-digital spectrum is 396,803 Hz. The amplitude of each subcarrier can be scaled by an amplitude scale factor. The secondary sideband amplitude scale factors can be user selectable. Any one of the four may be selected for application to the secondary sidebands.

In each of the waveforms, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform, the digital signal is transmitted in primary main (PM) sidebands on either side of the analog FM signal in the hybrid waveform. The power level of each sideband is appreciably below the total power in the analog FM signal. The analog signal may be monophonic or stereo, and may include subsidiary communications authorization (SCA) channels.

In the extended hybrid waveform, the bandwidth of the hybrid sidebands can be extended toward the analog FM signal to increase digital capacity. This additional spectrum, allocated to the inner edge of each primary main sideband, is termed the primary extended (PX) sideband.

In the all-digital waveform, the analog signal is removed and the bandwidth of the primary digital sidebands is fully extended as in the extended hybrid waveform. In addition, this waveform allows lower-power digital secondary sidebands to be transmitted in the spectrum vacated by the analog FM signal.

Figure 5:
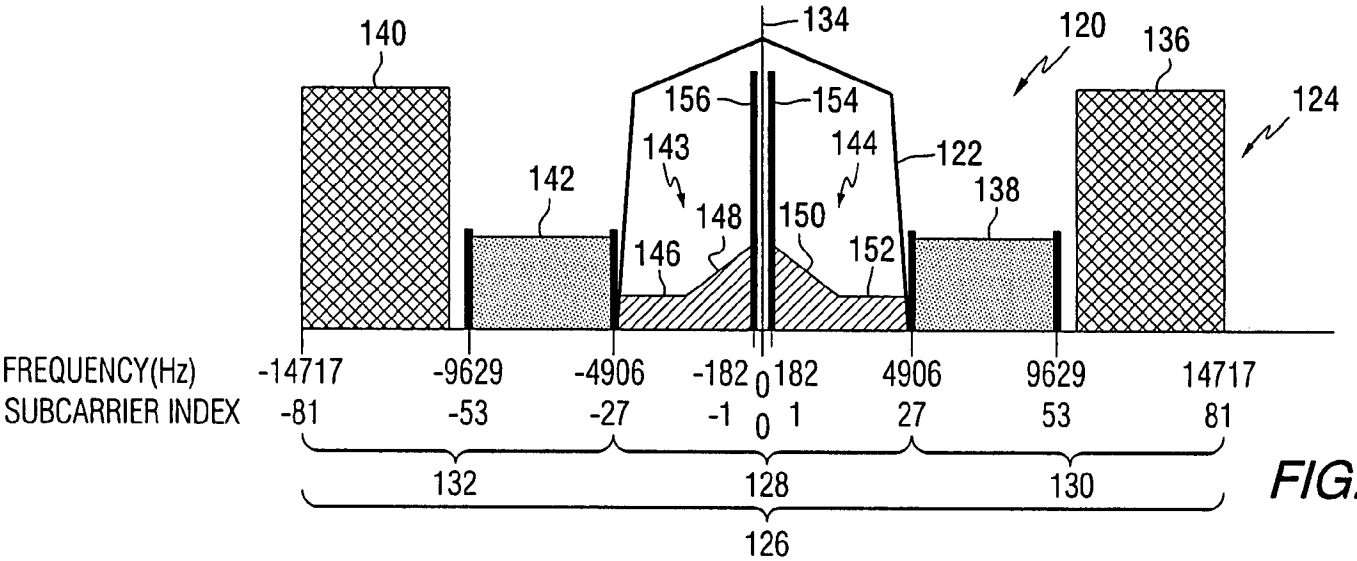
FIG. 5 is a schematic representation of a hybrid AM IBOC DAB waveform.

FIG. 5 is a schematic representation of an AM hybrid IBOC DAB waveform 120. The hybrid format includes the conventional AM analog signal 122 (bandlimited to about ±5 kHz) along with a nearly 30 kHz wide DAB signal 124. The spectrum is contained within a channel 126 having a bandwidth of about 30 kHz. The channel is divided into upper 130 and lower 132 frequency bands. The upper band extends from the center frequency of the channel to about +15 kHz from the center frequency. The lower band extends from the center frequency to about −15 kHz from the center frequency.

The AM hybrid IBOC DAB signal format in one example comprises the analog modulated carrier signal 134 plus OFDM subcarrier locations spanning the upper and lower bands. Coded digital information representative of the audio or data signals to be transmitted (program material), is transmitted on the subcarriers. The symbol rate is less than the subcarrier spacing due to a guard time between symbols.

As shown in FIG. 5, the upper band is divided into a primary section 136, a secondary section 138, and a tertiary section 144. The lower band is divided into a primary section 140, a secondary section 142, and a tertiary section 143. For the purpose of this explanation, the tertiary sections 143 and 144 can be considered to include a plurality of groups of subcarriers labeled 146, 148, 150 and 152 in FIG. 5. Subcarriers within the tertiary sections that are positioned near the center of the channel are referred to as inner subcarriers, and subcarriers within the tertiary sections that are positioned farther from the center of the channel are referred to as outer subcarriers. In this example, the power level of the inner subcarriers in groups 148 and 150 is shown to decrease linearly with frequency spacing from the center frequency. The remaining groups of subcarriers 146 and 152 in the tertiary sections have substantially constant power levels. FIG. 5 also shows two reference subcarriers 154 and 156 for system control, whose levels are fixed at a value that is different from the other sidebands.

The power of subcarriers in the digital sidebands is significantly below the total power in the analog AM signal. The level of each OFDM subcarrier within a given primary or secondary section is fixed at a constant value. Primary or secondary sections may be scaled relative to each other. In addition, status and control information is transmitted on reference subcarriers located on either side of the main carrier. A separate logical channel, such as an IBOC Data Service (IDS) channel can be transmitted in individual subcarriers just above and below the frequency edges of the upper and lower secondary sidebands. The power level of each primary OFDM subcarrier is fixed relative to the unmodulated main analog carrier. However, the power level of the secondary subcarriers, logical channel subcarriers, and tertiary subcarriers is adjustable.

Using the modulation format of FIG. 5, the analog modulated carrier and the digitally modulated subcarriers are transmitted within the channel mask specified for standard AM broadcasting in the United States. The hybrid system uses the analog AM signal for tuning and backup.

Figure 6:
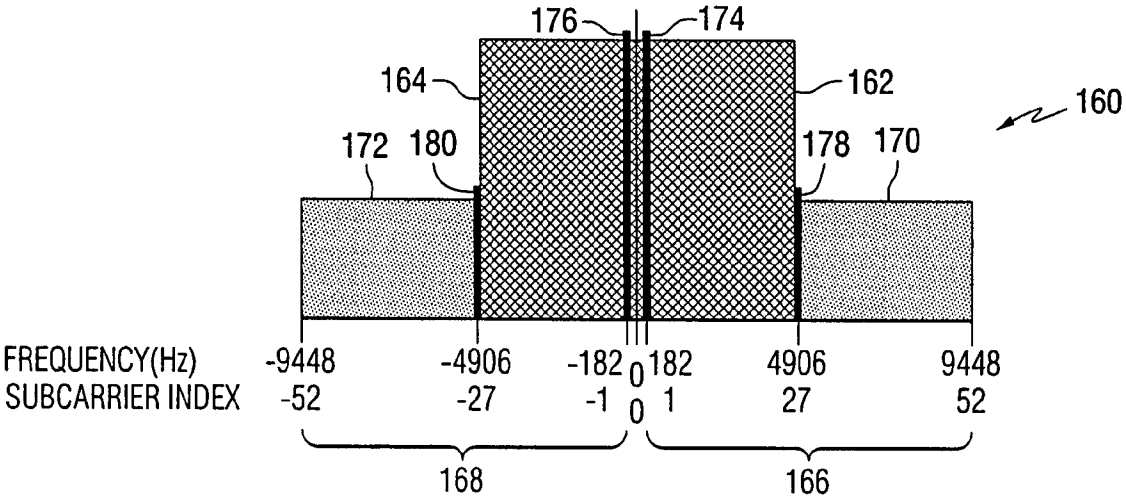
FIG. 6 is a schematic representation of an all-digital AM IBOC DAB waveform.

FIG. 6 is a schematic representation of the subcarrier assignments for an all-digital AM IBOC DAB waveform. The all-digital AM IBOC DAB signal 160 includes first and second groups 162 and 164 of evenly spaced subcarriers, referred to as the primary subcarriers, that are positioned in upper and lower bands 166 and 168. Third and fourth groups 170 and 172 of subcarriers, referred to as secondary and tertiary subcarriers respectively, are also positioned in upper and lower bands 166 and 168. Two reference subcarriers 174 and 176 of the third group lie closest to the center of the channel. Subcarriers 178 and 180 can be used to transmit program information data.

Figure 7:
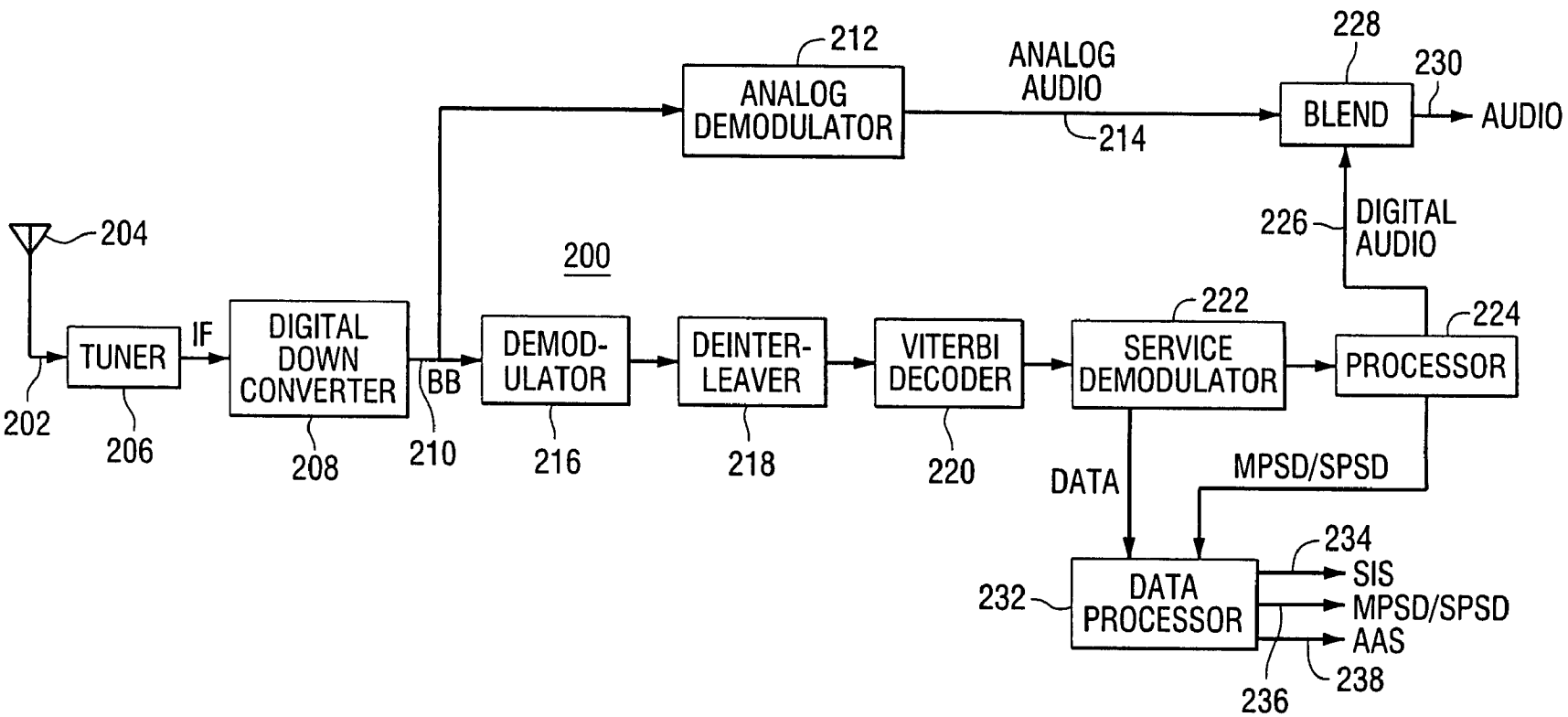
FIG. 7 is a functional block diagram of an AM IBOC DAB receiver.

FIG. 7 is a simplified functional block diagram of an AM IBOC DAB receiver 200. The receiver includes an input 202 connected to an antenna 204, a tuner or front end 206, and a digital down converter 208 for producing a baseband signal on line 210. An analog demodulator 212 demodulates the analog modulated portion of the baseband signal to produce an analog audio signal on line 214. A digital demodulator 216 demodulates the digitally modulated portion of the baseband signal. Then the digital signal is deinterleaved by a deinterleaver 218, and decoded by a Viterbi decoder 220. A service demodulator 222 separates main and supplemental program signals from data signals. A processor 224 processes the program signals to produce a digital audio signal on line 226. The analog and main digital audio signals are blended as shown in block 228, or a supplemental digital audio signal is passed through, to produce an audio output on line 230. A data processor 232 processes the data signals and produces data output signals on lines 234, 236 and 238. The data signals can include, for example, a station information service (SIS), main program service data (MPSD), supplemental program service data (SPSD), and one or more auxiliary application services (AAS).

Figure 8:
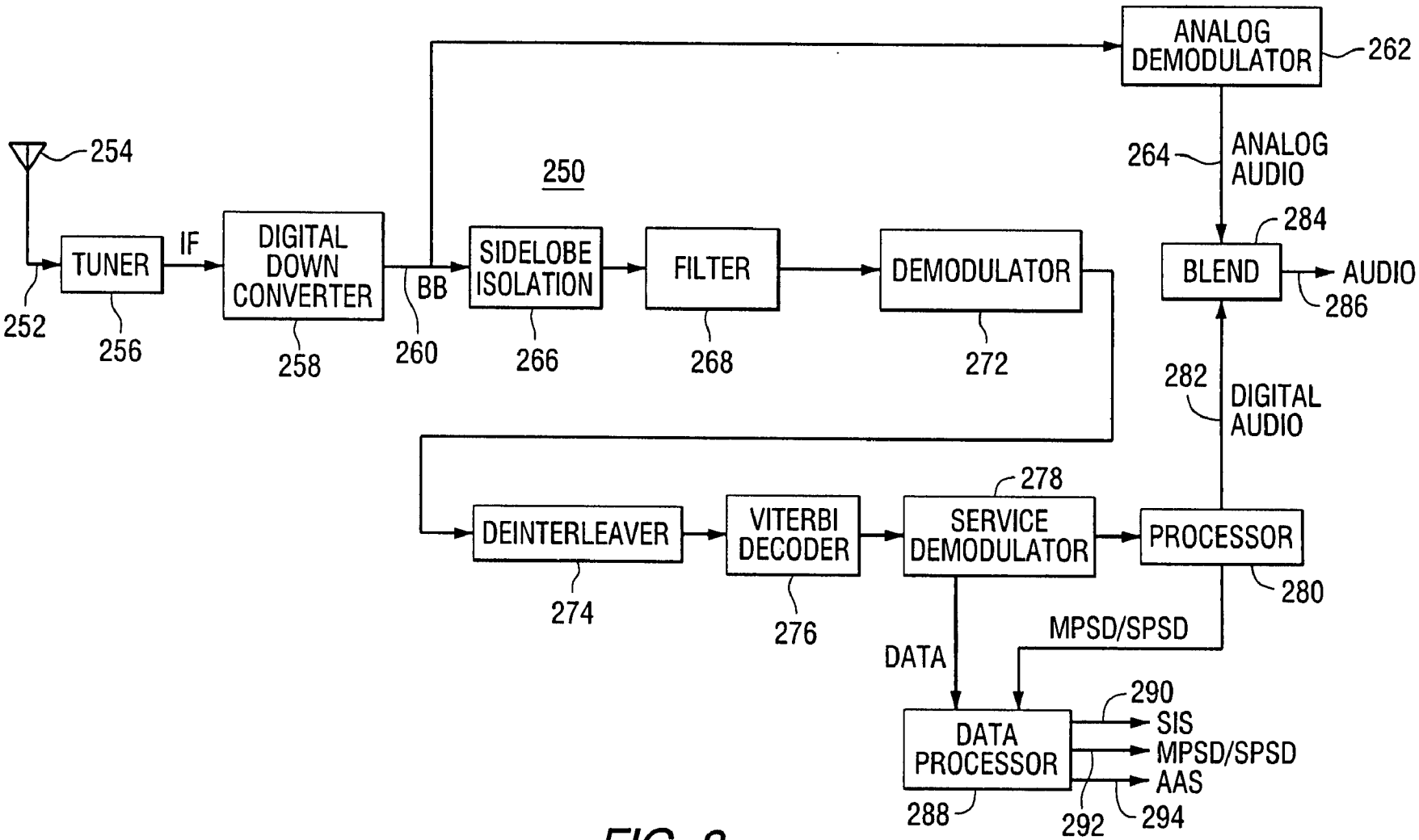
FIG. 8 is a functional block diagram of an FM IBOC DAB receiver.

FIG. 8 is a simplified functional block diagram of an FM IBOC DAB receiver 250. The receiver includes an input 252 connected to an antenna 254, a tuner or front end 256, and a digital down converter 258 for producing a baseband signal on line 260. An analog demodulator 262 demodulates the analog modulated portion of the baseband signal to produce an analog audio signal on line 264. The sideband signals are isolated as shown in block 266, filtered (block 268), and demodulated (block 272) to demodulate the digitally modulated portion of the baseband signal. Then the digital signal is deinterleaved by a deinterleaver 274, and decoded by a Viterbi decoder 276. A service demodulator 278 separates main and supplemental program signals from data signals. A processor 280 processes the main and supplemental program signals to produce a digital audio signal on line 282. The analog and main digital audio signals are blended as shown in block 284, or the supplemental program signal is passed through, to produce an audio output on line 286. A data processor 288 processes the data signals and produces data output signals on lines 290, 292 and 294. The data signals can include, for example, a station information service (SIS), main program service data (MPSD), supplemental program service data (SPSD), and one or more auxiliary application services (AAS).

In practice, many of the signal processing functions shown in the receivers of FIGS. 7 and 8 can be implemented using one or more integrated circuits.

Figure 9:
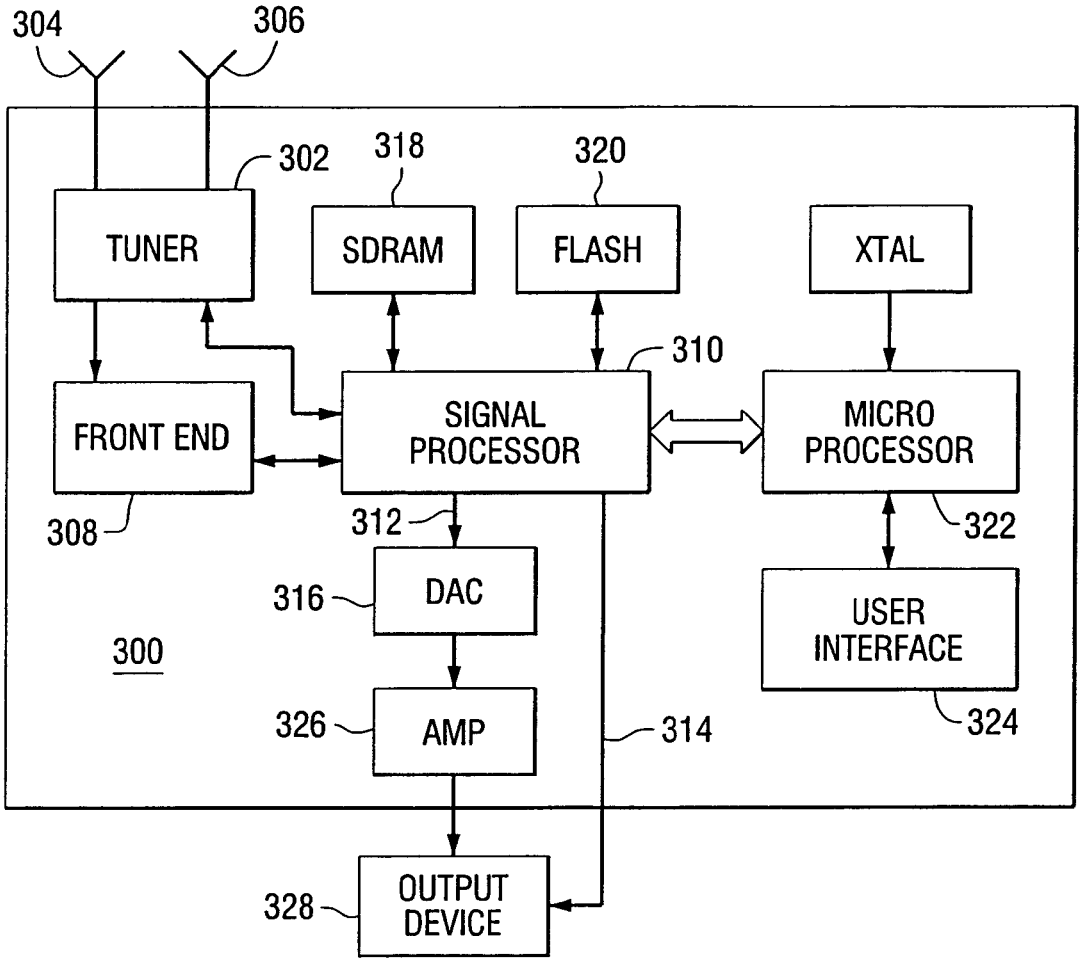
FIG. 9 is a simplified block diagram of an IBOC DAB receiver.

FIG. 9 is a simplified block diagram showing the components of an IBOC DAB receiver 300. The receiver includes a tuner 302 having inputs for connecting an FM antenna 304 and an AM antenna 306. The tuner is connected to an analog front end circuit 308 and a digital signal processor 310. The front end circuit 308 transforms the input signal to baseband. The digital signal processor 310 processes the baseband signal to produce digital audio and data output signals on lines 312 and 314. A digital-to-analog converter 316 is provided to convert the digital signal on line 312 to an analog audio signal. Memory 318 and 320 is provided for use by the digital signal processor. A microprocessor 322 is connected to the tuner and digital signal processor. The microprocessor is also coupled to a user interface 324, which can include, for example, a display, a keypad, rotary encoders, and/or an infrared remote. The audio output signals from the digital signal processor can be amplified by amplifier 326 and sent to an output device 328, which can include speakers or a headphone and a display.

Figure 10A:
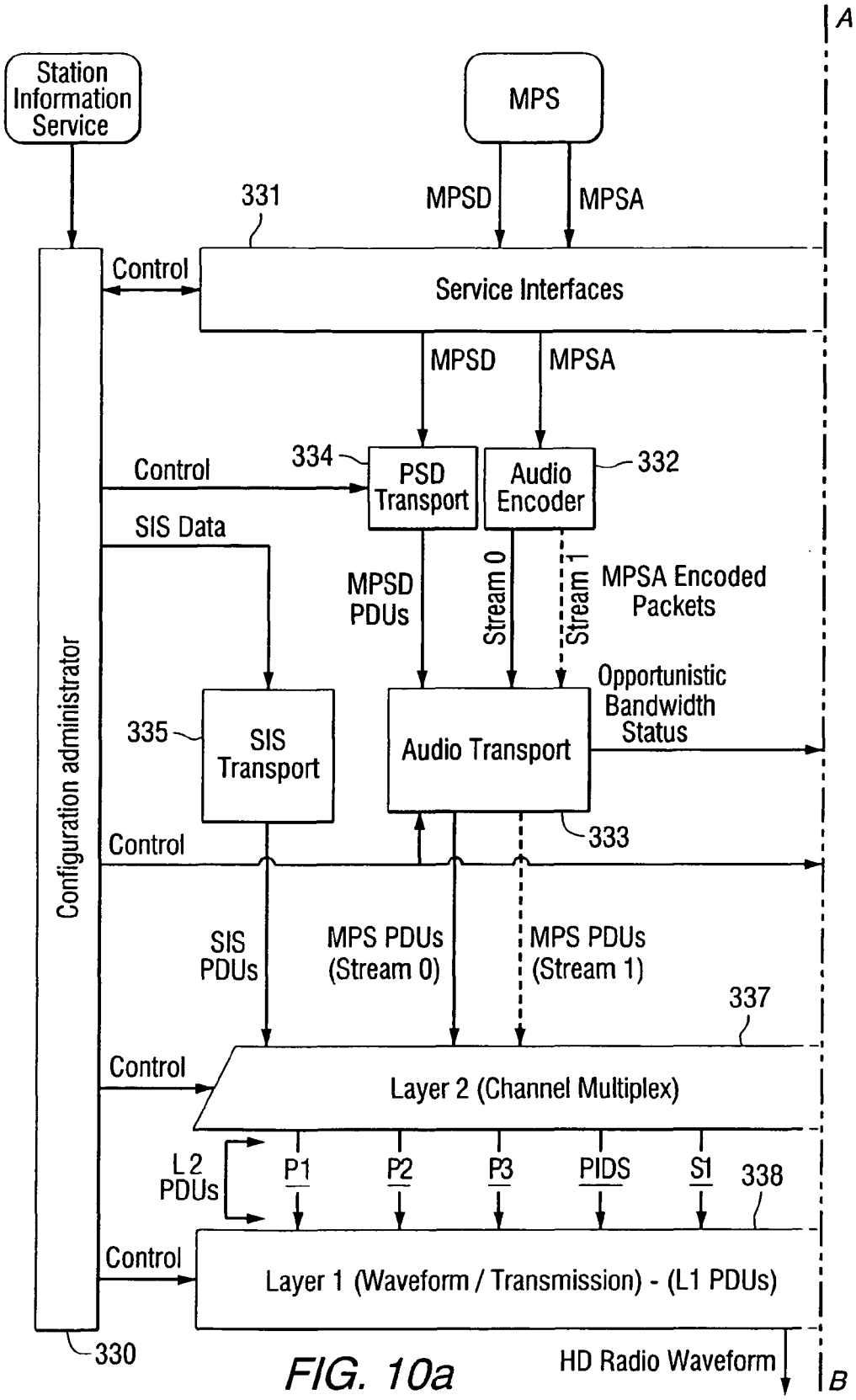
FIGS. 10*a* and 10*b* are diagrams of an IBOC DAB logical protocol stack.
Figure 10B:
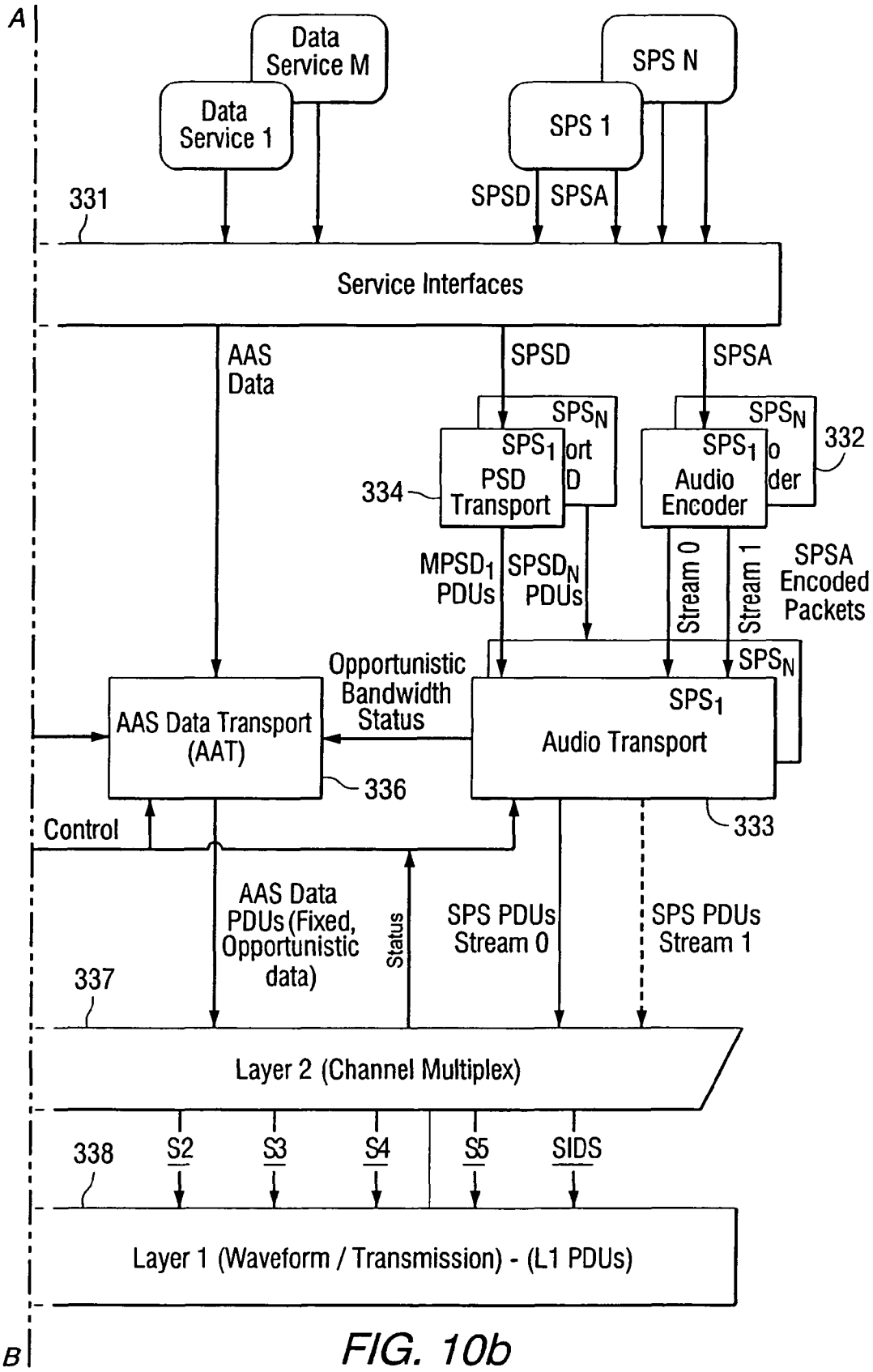

FIGS. 10*a* and 10*b* are diagrams of an IBOC DAB logical protocol stack from the transmitter perspective. From the receiver perspective, the logical stack will be traversed in the opposite direction. Most of the data being passed between the various entities within the protocol stack are in the form of protocol data units (PDUs). A PDU is a structured data block that is produced by a specific layer (or process within a layer) of the protocol stack. The PDUs of a given layer may encapsulate PDUs from the next higher layer of the stack and/or include content data and protocol control information originating in the layer (or process) itself. The PDUs generated by each layer (or process) in the transmitter protocol stack are inputs to a corresponding layer (or process) in the receiver protocol stack.

As shown in FIGS. 10*a* and 10*b*, there is a configuration administrator 330, which is a system function that supplies configuration and control information to the various entities within the protocol stack. The configuration/control information can include user defined settings, as well as information generated from within the system such as GPS time and position. The service interfaces 331 represent the interfaces for all services except SIS. The service interface may be different for each of the various types of services. For example, for MPS audio and SPS audio, the service interface may be an audio card. For MPS data and SPS data the interfaces may be in the form of different application program interfaces (APIs). For all other data services the interface is in the form of a single API. An audio codec 332 encodes both MPS audio and SPS audio to produce streams of MPS and SPS audio encoded packets, which are passed to audio transport 333. Audio codec 332 also relays unused capacity status to other parts of the system, thus allowing the inclusion of opportunistic data. UPS and SPS data is processed by program service data (PSD) transport 334 to produce MPS and SPS data PDUs, which are passed to audio transport 333. Audio transport 333 receives encoded audio packets and PSD PDUs, and outputs bit streams containing both compressed audio and program service data. The SIS transport 335 receives SIS data from the configuration administrator and generates SIS PDUs. A SIS PDU can contain station identification and location information, as well as absolute time and position correlated to GPS. The AAS data transport 336 receives AAS data from the service interface, as well as opportunistic bandwidth data from the audio transport, and generates AAS data PDUs, which can be based on quality of service parameters. Layer 2 (337) receives transport PDUs from the SIS transport, AAS data transport, and audio transport, and formats them into Layer 2 PDUs. A Layer 2 PDU includes protocol control information and a payload, which can be audio, data, or a combination of audio and data. Layer 2 PDUs are routed through the correct logical channels to Layer 1 (338). There are multiple Layer 1 logical channels based on service mode. The number of active Layer 1 logical channels and the characteristics defining them vary for each service mode. Status information is also passed between Layer 2 and Layer 1. Layer 1 converts the PDUs from Layer 2 and system control information into an AM or FM IBOC DAB waveform for transmission. Layer 1 processing can include scrambling, channel encoding, interleaving, OFDM subcarrier mapping, and OFDM signal generation. The output of OFDM signal generation is a complex, baseband, time domain pulse representing the digital portion of an IBOC signal for a particular symbol. Discrete symbols are concatenated to form a continuous time domain waveform, which is modulated to create an IBOC waveform for transmission.

Figure 11:
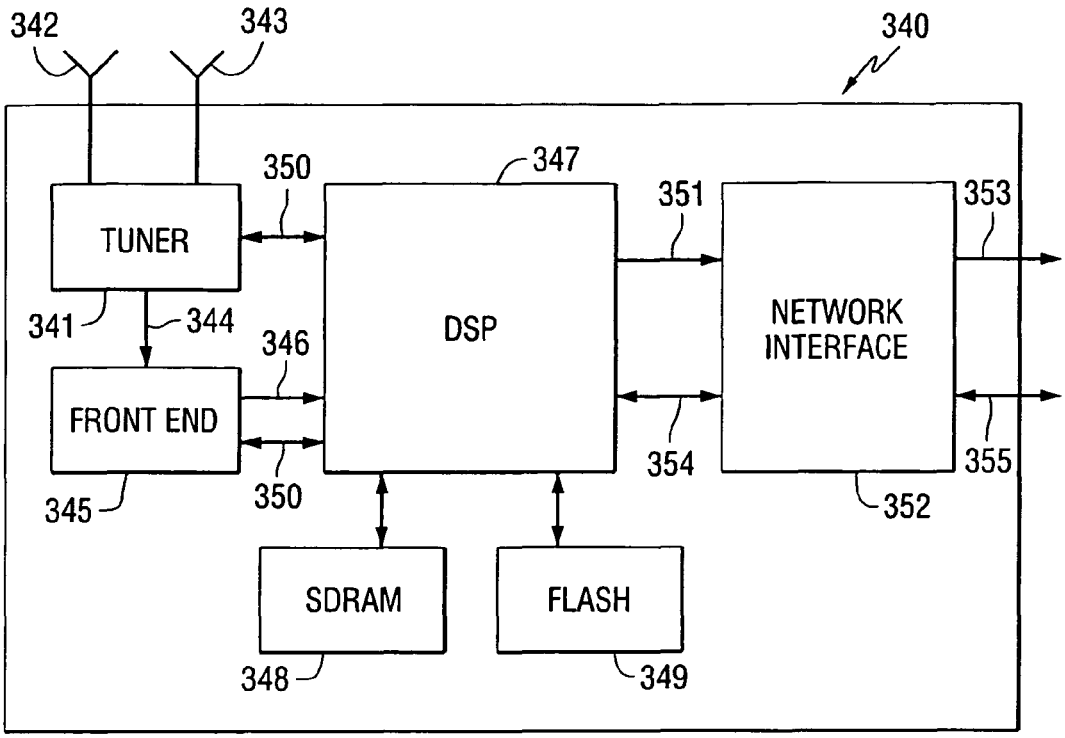
FIG. 11 is a simplified block diagram of an IBOC DAB network receiver.

FIG. 11 is a simplified block diagram of the components of an IBOC DAB network receiver. The network receiver 340 includes a tuner 341 having inputs for connecting an AM antenna 342 and an FM antenna 343 for receiving radio signals, which may be modulated with an all-digital, all-analog, or hybrid IBOC waveform. The tuner produces an intermediate frequency (IF) signal 344 that is passed to a front end circuit 345, which transforms the IF signal to a baseband signal 346. Digital signal processor (DSP) 347 processes the baseband signal, as described in more detail below. Memories 348 and 349 are provided for use by the DSP. Command and status information 350 is passed between the DSP and tuner and front end. If the received signal is modulated with an all-digital or hybrid IBOC waveform, the DSP 347 processes the baseband signal pursuant to the logical protocol stack described in FIGS. 10*a* and 10*b* from the receiver perspective to produce an output signal 351 (also referred to as an intermediate signal) comprised of encoded audio content and data. If the received signal is purely analog, then processing of the signal according to the protocol stack is bypassed and the signal processor outputs an unencoded, standard pulse code modulated (PCM) audio signal. Intermediate signal 351 may optionally be encrypted. Functionally, to produce signal 351 the network receiver performs many of the same functions as described with respect to FIG. 7 and FIG. 8. Intermediate signal 351 is passed to network interface 352, which formats the signal for output 353 according to the appropriate network access protocol for transmission to one or more network players, either directly or via a network router. The output signal is referred to as a receiver output signal.

Any suitable network access protocol may be used. For example, the network interface may format the signal for transmission to a router over a wired Ethernet connection or a wired USB connection. The network interface may also format the signal for wireless transmission such as according to the IEEE 802.11 ("Wi-Fi"), IEEE 801.16 ("WiMAX"), IEEE 802.20 ("WMBA") specifications, or Bluetooth for example. The network interface may also output a signal for direct connection, either wired or wireless, to a network player. A directly wired connection may use digital differential connectivity such as LVDS or a specialty protocol such as those used by high end home audio systems, whereas a wireless connection may use any of the protocols described above. A user may select between a direct connection to a network player and a networked connection via a router by flipping a switch, or pressing a button, on the exterior of the network receiver. Command and status information 354 and 355 is also passed between the network receiver and network player. Command information can include commands such as changing the frequency that is being received by the network receiver, for example. The network receiver includes the necessary hardware, such as Ethernet or USB connection points and antenna(s), for effectuating the transmission protocols implemented by the network interface.

Figure 12:
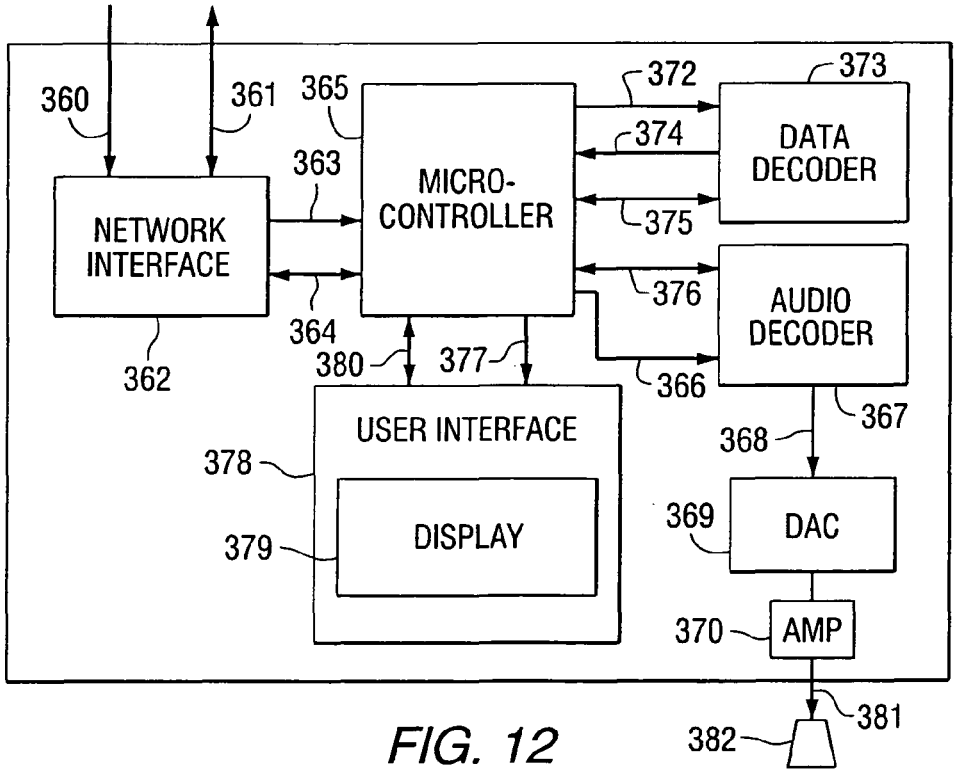
FIG. 12 is a simplified block diagram of an IBOC DAB network player.

FIG. 12 is a simplified block diagram of the components of an IBOC network player. The network player receives the receiver output signal containing coded audio and data 360 and sends and receives command and status information 361, both formatted according to the appropriate network access protocol used by the network receiver. A network interface 362 processes the signals pursuant to the network access protocol to produce an unformatted encoded audio and data signal 363. The network interface also sends and receives status and control information 364 to and from a processor or microcontroller 365. The microcontroller outputs an encoded audio signal 366 to audio decoder 367 for decoding. The decoded audio signal 368 is passed to digital-to-analog converter 369 and amplifier 370, which sends an analog audio signal 381 to an audio output device 382 such as speakers or headphones. Alternatively, the decoded audio signal could be passed to a digital amplifier, which supplies an audio signal for output by the audio output device. The microcontroller also outputs any encoded data 372 to a data decoder 373, which decodes the data and outputs a decoded data signal 374 to the microcontroller. The microcontroller exchanges command and status information 375 and 376 with the data decoder and audio decoder. The microcontroller passes decoded data 377 to a user interface 378, which includes a display 379. Command and status information 380 is also exchanged between the microprocessor and user interface. The user interface 378 includes controls for activation by a user. These controls can allow the user to implement various functions such as changing the frequency of a received station, increasing or decreasing the volume of the audio output, selecting between main or secondary programs, responding to received data, utilizing an electronic program guide, or utilizing store-and-replay functionality, for example. The controls may be implemented using buttons, switches and other activation mechanisms, either alone or in combination with a software implemented graphical user interface.

Figure 13:
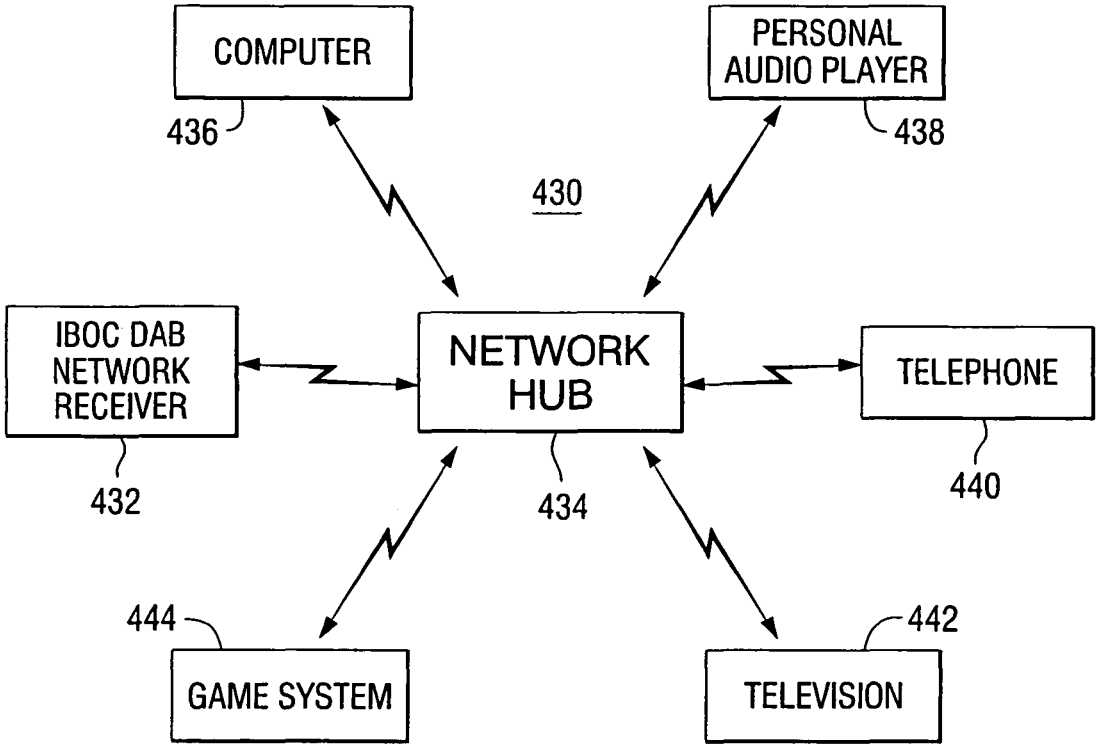
FIG. 13 is a schematic representation of a network including an IBOC DAB network receiver and several different kinds of IBOC DAB network players.

FIG. 13 is a block diagram of a system 430 that includes a network receiver 432 constructed in accordance with the invention. The network receiver receives the IBOC DAB signal and produces one or more receiver output signals. The output signal is then transmitted to a network interface device (also referred to as a router or hub) 434 using a wired or wireless communications link. The router can be any type of networking device that is capable of receiving and routing a signal, including those that are presently well-known in the art and commercially available for a home, office, or any other form of local network. The router then routes the signals to one or more network players 436-444. The network players can include, for example, a computer 436, a personal audio player 438, a phone 440, which could be a mobile or cellular phone or a VoIP compatible phone, a television 442, and a game system 444. The network receiver can be positioned at any convenient RF reception point at the home or office. While various players can be included, the network receiver can be the same in all systems. Each of the network player devices requires software that gives the player the capability to receive and handle IBOC signals corresponding to layers L2 through L4 of the protocol stack, including audio and data components, and that drives an appropriate user interface. This software may be obtained and loaded on a player in various ways, including, for example, by accessing a Web site and downloading the software directly onto the player, as would be particularly appropriate when the player has Internet access, as is the case with a laptop, desktop computer, or smart phone. In the case of a cell phone, a user could access a Web site and request the software, which is then loaded on the phone by the user's cellular service provider. A suitable graphical user interface would depend on the size and capabilities of the player's display, as well as the control points of each player, such as the buttons on a cell phone or a portable hand-held device. The user interface would permit a user to, for example, tune to a particular station, select a program within the content channel broadcast by that station, access and play stored material, record content, and interact with data content.

In the example of FIG. 13, a single network receiver includes a single tuner, so only one person at a time can control the station being heard. The controlling player can be the first player to begin a dialogue with the network receiver by logging on or otherwise requesting access to the receiver's output. When the user requests a station that broadcasts main program audio and one or more supplemental audio programs, then in one embodiment the network receiver routes the program that is requested by the player, as well as any associated data. Alternatively, the network receiver may route as a bundle all of the content from a single station, in which case the network player parses that content to play only the particular program selected by the user. Other subsidiary players can also access the content available on the same channel as the one selected by the controlling player. For example, if a single channel includes a main audio program and two supplemental programs, then any player on the network can request to receive any one of these three programs. In one embodiment, the network receiver separately routes each of the programs for which it has received a request from a network player. Alternatively, the network receiver may route as a bundle all of the content on a single channel, in which case the network players will parse the content to play only the program selected by a particular user.

A single network receiver may provide content to any number of network players. For example, a network receiver may be located at a sports stadium. The attendees of a sports event such as a baseball game may desire to hear a sportscaster's commentary about the game, along with other related audio or data content. This content can be generated by a radio station or other source and then broadcast. The network receiver receives this broadcast and then routes the content to any network player in the stadium that is capable of receiving the signal. The network players can further include one or more televisions (using a wired or wireless connection), with an adapter that can be hidden away in a small box.

In the above described embodiments, the network receiver and network player together perform the necessary processing of a received signal pursuant to the logical protocol stack to produce an audio output and data output and provide the function of a user interface. For example, the network receiver may process the signal through layer L2 of the protocol stack and then route L2 PDUs to a network player to complete the processing. As another example, the network receiver may process the signal through layer L4 of the protocol stack and then route L4 PDUs to a network player to complete the processing. As a still further alternative, the network receiver may produce a fully decoded PCM signal for routing to the network player. In addition, the network receiver may route PDUs from a particular layer of the protocol stack to a storage device. The PDUs then may be later retrieved by a network player or other device to complete processing. The stored PDUs may also be distributed via a wide area network, such as the Internet, to another location where processing can be completed.

Figure 14:
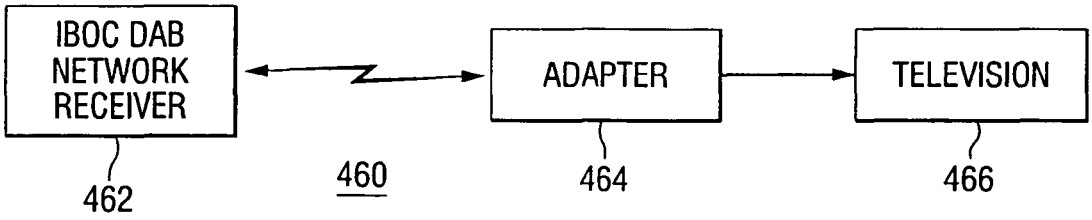
FIG. 14 is a schematic representation of another network including an IBOC DAB network receiver and a television.
Figure 15:
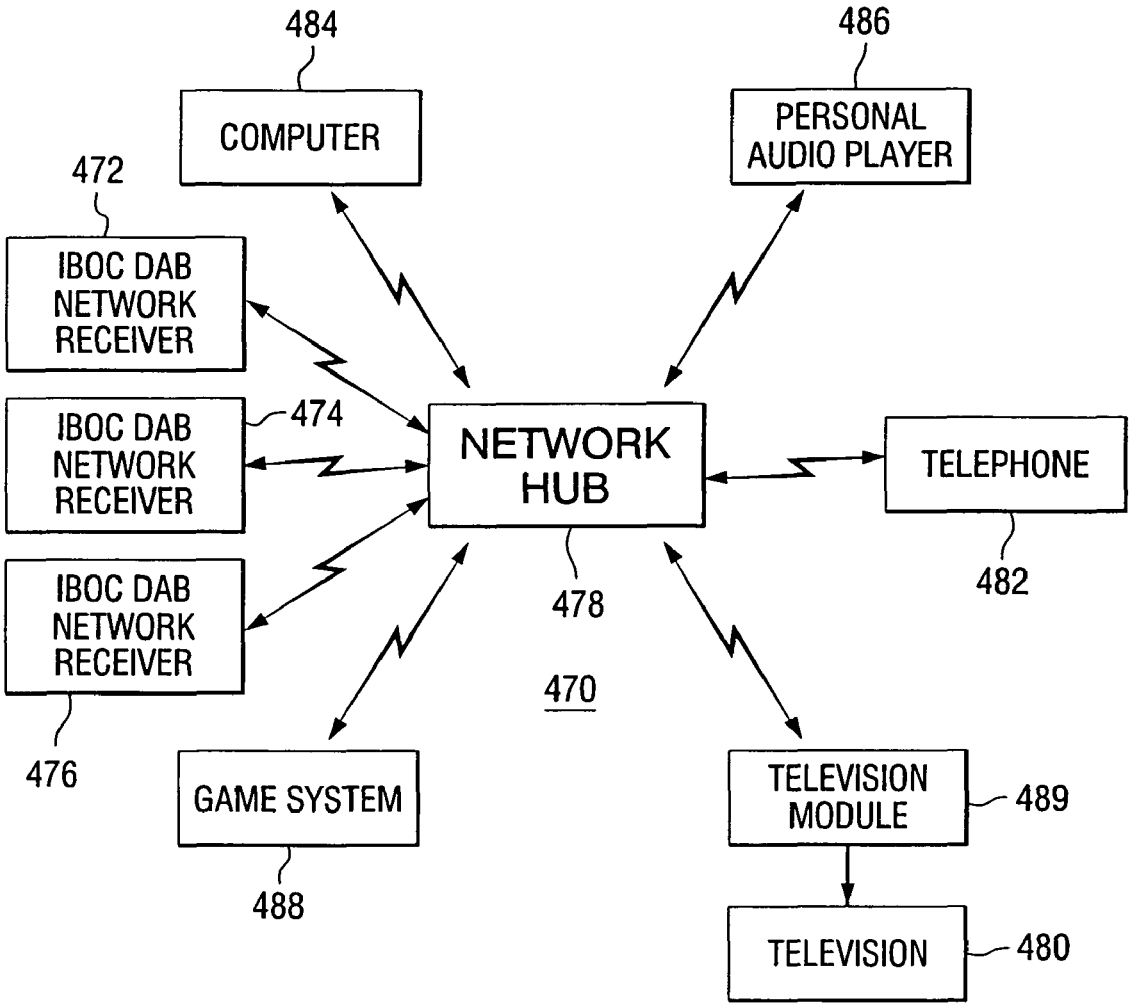
FIG. 15 is a schematic representation of another network including a plurality of IBOC DAB network receivers.

FIG. 14 is a block diagram of a system 460 that includes a network receiver 462 constructed in accordance with the invention and that is directly connected to a network player adapter 464 for connection to a television 466. The network receiver receives the IBOC DAB signal and produces a receiver output signal as previously described, which is then transmitted via a wired or wireless communications link to adapter 464. The adapter decodes the encoded audio and data in the receiver output signal in the same manner as the previously described network player, and then produces an audio signal and a video signal. The adapter can be connected to television 466 using, for example, an RCA audio/video cable. The adapter can connect to any TV and use the TV display and remote control. Thus, the components of the adapter 466 are similar to those of the network player shown in FIG. 12, except that an integrated user interface, display, and audio output are no longer required because the television provides these elements.

Where multiple users desire to listen to multiple stations, multiple network receivers can be used in the same local network. FIG. 15 is a block diagram of a system 470 that includes a plurality of network receivers 472, 474 and 476 constructed in accordance with the invention. The network receivers receive the IBOC DAB signal and produce multiple receiver output signals. The output signals are then sent to a network interface device (also referred to as a router or hub) 478 using a wired or wireless communications link. The router then routes the signals to one or more network players, including for example, one or more televisions 480, phones 482, computers 484, personal audio players 486 and/or game systems 488. A television adapter module 489 can be used to convert the network signal to a television compatible signal. Optionally, instead of using separate network receiver devices, multiple network receiver boards may be incorporated into a single network receiver rack.

The devices described above can be operated to perform a method including: receiving an over-the-air in-band on-channel broadcast signal and extracting broadcast content from the broadcast signal, and delivering the content by way of a first receiver output signal to a plurality of network player devices. The method can further include: converting the broadcast signal to a baseband signal, processing the baseband signal according to a protocol stack to produce an intermediate signal, and processing the intermediate signal to produce the output signal. The intermediate signal can be encrypted. The content can include multiple programs and/or data received in a single broadcast channel.

While the invention has been described in terms of several embodiments, it will be apparent to those skilled in the art that various changes can be made to the described embodiments without departing from the scope of the invention as set forth in the following claims.

What is claimed is:

1. An apparatus comprising:

a network receiver for receiving an over-the-air in-band on-channel broadcast signal on a channel selected by a first network player device and extracting encoded broadcast content from the broadcast signal, wherein the network receiver includes:

a front end for converting the broadcast signal to a baseband signal;

a processor for processing the baseband signal according to a portion of a protocol stack to produce an intermediate signal representing encoded broadcast content; and a network receiver interface for formatting the intermediate signal according to a network access protocol to produce formatted and encoded broadcast content; and means for delivering the formatted and encoded broadcast content to the first network player device and one or more additional network player devices, wherein the network player devices complete processing of the intermediate signal according to the protocol stack to recover the broadcast content.

2. The apparatus of claim 1, wherein the intermediate signal is encrypted.

3. The apparatus of claim 1, wherein the processor processes the baseband signal according to the protocol stack if the broadcast signal is a digital audio broadcast signal or produces a pulse code modulated signal if the broadcast signal is an analog signal.

4. The apparatus of claim 1, wherein the content includes multiple programs and/or data received in a single broadcast channel and each of the network player devices completes processing of the intermediate signal according to the protocol stack to recover one of the programs and/or data.

5. The apparatus of claim 1, wherein the network player devices include a network player interface for receiving the formatted and encoded broadcast content, and a processor for processing the formatted and encoded broadcast content receiver output signal according to the protocol stack to recover the content.

6. The apparatus of claim 1, wherein the first network player exchanges command and status information with the network receiver.

7. The apparatus of claim 1, wherein the first network player further includes:

a user interface having controls for activating functions of the network receiver.

8. The apparatus of claim 1, wherein the means for delivering the formatted and encoded broadcast content comprises:

a network router for receiving the formatted and encoded broadcast content and distributing the content to one or more network players.

9. The apparatus of claim 8, further comprising:

a second network receiver for receiving a second over-the-air in-band on-channel broadcast signal and extracting second broadcast content from the second broadcast signal; and a second output for delivering the second content to the means for delivering the formatted and encoded broadcast content.

10. The network player of claim 1, wherein the protocol stack comprises an in-band on-channel protocol stack.

11. The network player of claim 1, further comprising:

a storage device for storing protocol data units in the intermediate signal.

12. A method comprising:

using a network receiver to receive an over-the-air in-band on-channel broadcast signal on a channel selected by a first network player device and extracting encoded broadcast content from the broadcast signal;

converting the broadcast signal to a baseband signal;

processing the baseband signal according to a portion of a protocol stack to produce an intermediate signal representing encoded broadcast content;

formatting the intermediate signal according to a network access protocol to produce a formatted and encoded broadcast content;

delivering the formatted and encoded broadcast content to the first network player device and one or more additional network player devices; and using the network player devices to complete processing of the intermediate signal in accordance with the protocol stack to recover the content.

13. The method of claim 12, further comprising:

encrypting the intermediate signal.

14. The method of claim 12, wherein the baseband signal is processed according to the protocol stack if the broadcast signal is a digital audio broadcast signal or converted to a pulse code modulated signal if the broadcast signal is an analog signal.

15. The method of claim 12, wherein the content includes multiple programs and/or data received in the single broadcast channel and each of the network player devices completes processing of the intermediate signal according to the protocol stack to recover one of the programs and/or data.

16. The method of claim 12, further comprising:

exchanging command and status information between the network receiver and the first network player device.

17. The method of claim 12, wherein the first network player device includes:

a user interface having controls for activating functions of the network receiver.

18. The method of claim 12, further comprising:

using a network router to distribute the formatted and encoded broadcast content to the network player devices.

* * * * *